US007380511B2

(12) United States Patent
Koike et al.

(10) Patent No.: US 7,380,511 B2
(45) Date of Patent: Jun. 3, 2008

(54) AUTOMATIC THREAD CUTTING DEVICE FOR SEWING MACHINE PROVIDED WITH HORIZONTAL LOOP TAKER

(75) Inventors: Mikio Koike, Tokyo (JP); Koji Okutani, Tokyo (JP); Eiji Kanno, Tokyo (JP); Hideaki Kambara, Tokyo (JP); Masashi Ninomiya, Tokyo (JP); Eiichi Shomura, Tokyo (JP); Satoshi Maruo, Tokyo (JP); Mitsuru Nishijima, Tokyo (JP); Michio Hisatake, Tokyo (JP)

(73) Assignee: Janome Sewing Machine Co., Ltd., Tokyo (JP)

( * ) Notice: Subject to any disclaimer, the term of this patent is extended or adjusted under 35 U.S.C. 154(b) by 0 days.

(21) Appl. No.: 11/446,998

(22) Filed: Jun. 5, 2006

(65) Prior Publication Data

US 2007/0056492 A1 Mar. 15, 2007

(30) Foreign Application Priority Data

Jun. 30, 2005 (JP) ..... 2005-193196

(51) Int. Cl.
*D05B 65/00* (2006.01)

(52) U.S. Cl. ..... 112/291; 112/285; 112/300

(58) Field of Classification Search ..... 112/285, 112/286, 291, 292, 293, 295, 300, 296, 299; 700/136, 138
See application file for complete search history.

(56) References Cited

U.S. PATENT DOCUMENTS 5,131,340 A * 7/1992 Tajima et al. ..... 112/292
5,289,791 A * 3/1994 Sanders et al. ..... 112/291
5,623,887 A * 4/1997 Tajima et al. ..... 112/291
5,784,989 A * 7/1998 Shimizu et al. ..... 112/300
6,152,058 A * 11/2000 Tajima et al. ..... 112/292
6,276,289 B1 * 8/2001 Wahlstrom ..... 112/292
2003/0183146 A1 * 10/2003 Usa ..... 112/285

FOREIGN PATENT DOCUMENTS

JP 06-339592 12/1994

* cited by examiner

*Primary Examiner*—Gary L. Welch
*Assistant Examiner*—Nathan E Durham
(74) *Attorney, Agent, or Firm*—Nields & Lemack

(57) ABSTRACT

Disclosed is an automatic thread cutting device for a sewing machine which is provided with a horizontal loop taker, wherein a thread catching member (4) is operated in response to a thread cutting instruction to reciprocatingly move with a movable blade (5) along a predetermined course, the thread catching member (4) normally catching the upper thread when moving in the return-way of reciprocation to guide the upper thread to a fixed blade (14) which is provided to cut the upper thread in cooperation with the movable blade (5), and wherein a thread regulating means is provided to cut the lower thread (29*d*) together with the upper thread, the thread regulating means being operated to press down the lower thread (29*d*) to a position where the lower thread (29*d*) is caught by the thread catching member (4) in addition to the upper thread when the thread catching member (4) is moving in the return-way of reciprocation.

6 Claims, 17 Drawing Sheets

(a)

(b)

AUTOMATIC THREAD CUTTING DEVICE FOR SEWING MACHINE PROVIDED WITH HORIZONTAL LOOP TAKER

BACKGROUND OF THE INVENTION

Field of the Invention

The present invention relates to an automatic thread cutting device and more particularly relates to an automatic thread cutting device for a sewing machine which is provided with a horizontal loop taker.

In case an automatic thread cutting device is employed in connection with a sewing machine provided with a vertical loop taker, a movable blade is operated in a horizontal plane to easily cut the upper and lower threads in corporation with a fixed blade, the upper and lower threads being extended substantially in a vertical plane between the loop taker and the needle plate. On the other hand, in case the automatic thread cutting device is employed in connection with a sewing machine provided with a horizontal loop taker, the effective thread cutting operation is rather difficult because the movable blade is required to catch the upper and lower threads which are extended in an inclined plane between the loop taker and the needle hole of the needle plate. An automatic thread cutting device that is used in connection with a sewing machine provided with a horizontal loop taker is disclosed, for example, in Japanese patent No. 2583394 (Juki Industrial Corporation). According to the thread cutting device, the threads are cut while the threads are pushed down by a thread push member to a plane that is lower than the thread catching member.

According to the patent document as mentioned above, a horizontal loop taker is employed in a sewing machine, and a movable blade is operated to cut the upper and lower threads in cooperation with a fixed blade. Precisely, the upper and lower threads are simultaneously cut.

However, in case the embroidery stitching operation is performed, it often happens that one of the upper and lower threads, that is only the upper thread is required to be exchanged with a thread of different color in dependence upon the pattern to be stitched. In this case, it is preferable for operational efficiency that only the upper thread is exchanged while the lower thread is successively used. In this connection, it is desired that a proper mechanism is provided to cut the upper thread only as occasion requires, while leaving the lower thread uncut. It is, therefore, an object of the invention to realize the desire for cutting the upper and lower threads simultaneously and for cutting the upper thread only while the lower thread is continuously used as is required.

SUMMARY OF THE INVENTION

The invention has been provided to eliminate the defects and disadvantages of the prior art. Namely the invention defined in the appended claim 1 relates to an automatic thread cutting device for a sewing machine which is provided with a horizontal loop taker, the automatic thread cutting device comprising a first instruction means operated to give a first instruction signal for cutting both of the upper and lower threads of sewing machine, a second instruction means operated to give a second instruction signal for cutting the upper thread only of sewing machine, a thread catching means operated in response to the first instruction signal to reciprocatingly move along a predetermined course to catch the upper and lower threads, the thread catching means operated in response to the second instruction signal to reciprocatingly move along a predetermined course to catch the upper thread while moving below the lower thread, a thread cutting means for cutting the upper and lower threads which may be caught by the thread catching means, a thread regulating means operated in response to the first instruction signal to move down the lower thread to a position where the lower thread is caught by the thread catching means as the latter is reciprocatingly moved.

With the structure as such, when the machine operator operates the first instruction means to produce the first instruction signal, the thread regulating means is operated in response to the first instruction signal to move down the lower thread to enable the thread catching means to catch the lower thread in addition to the upper thread. Thus the upper and lower threads as caught are cut by the thread cutting means.

On the other hand, when the machine operator operates the second instruction means to produce the second instruction signal, the thread regulating means is not operated while the thread catching means catches the upper thread only and moves below the lower thread. Thus the upper thread only as caught is cut by the thread cutting means.

Incidentally, in a preferred embodiment, the thread cutting means includes a movable blade which is reciprocatingly moved with the thread catching member and a fixed blade which is provided to cut the thread caught by the thread catching member in cooperation with the movable blade. The thread catching member is normally moved in reciprocation with the movable blade along a predetermined course below the lower thread as the later is extended. The thread catching member catches the upper thread in the return-way of reciprocation and guides the upper thread to the fixed blade. Further the thread regulating member is operated in response to the first instruction signal to press down the lower thread while the thread catching member is moving in the return-way of reciprocation. Thus the lower thread is caught by the thread catching member and is cut by cooperation of the movable blade and the fixed blade.

In this connection, it is preferable that the thread regulating means is extended across above the lower thread which is extended from the bobbin carried in the horizontal loop taker to the needle dropping hole of the needle plate, and that the thread regulating means includes a thread regulating bar arranged as extending substantially in parallel with the course along which the thread catching member is reciprocatingly moved, and swingable arms which are connected to the opposite ends of the thread regulating bar and are operated to move down the thread regulating bar while the thread catching member is moving in the return-way of reciprocation.

Incidentally, it is preferable that the thread regulating means is operated by a stepping motor or cam.

According to the invention, the first instruction means is selectively operated to cut both of the upper and lower threads. On the other hand, the second instruction means is selectively operated to cut the upper thread only. In the former case, the thread regulating means is operated to act on the lower thread so as to be caught by the thread catching means and cut by cooperation of the movable blade and the fixed blade. In the latter case, the thread regulating means is not operated and the lower thread is left untouched so that only the upper thread may be caught by the thread catching means and cut by cooperation of the movable blade and the fixed blade. Therefore, only the upper thread may be exchanged with the thread of different color as is required while the lower thread is used as unchanged. According to the invention, as the thread catching member is designed to catch the thread while moving in the return-way of reciprocation, the error may be avoided in the thread catching operation.

DETAILED DESCRIPTION OF THE PREFERRED EMBODIMENTS

Figure 1:
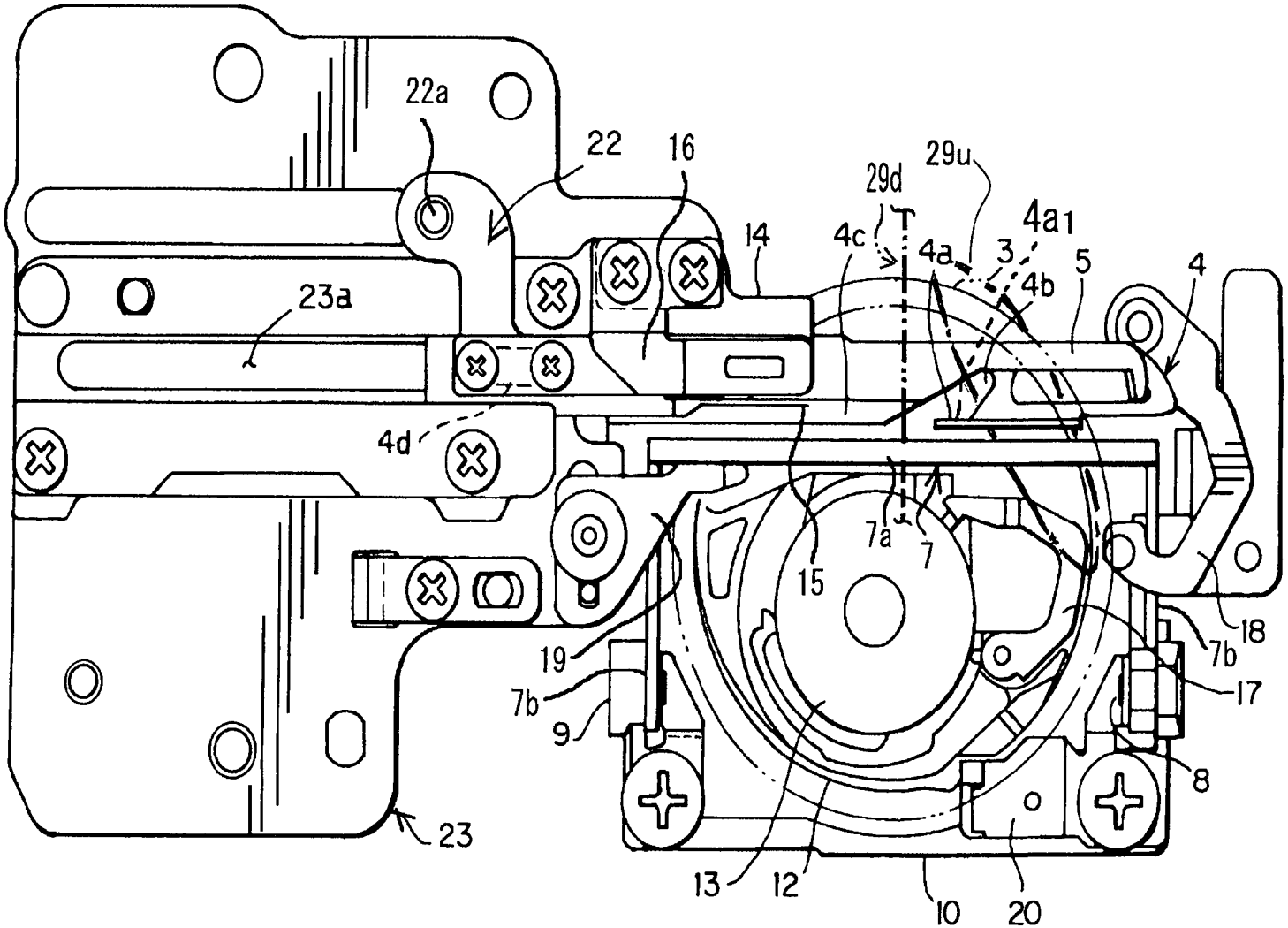
FIG. 1 is a plan elevational view of the essential parts of the invention shown in connection with a horizontal loop taker.

The invention will be described in reference to the embodiments as shown in the attached drawings. The invention substantially comprises a thread cutting means for cutting the upper thread 29U and the lower thread 29*d*, a thread catching means, and a thread regulating means which are arranged in connection with a needle plate 30 on a bed 12 of the machine body and a loop taker 3. As particularly shown in FIG. 4, the loop taker 3 is arranged in the bed 12 as is rotatable around a loop taker shaft 2 below and forwardly of a machine needle 1. The thread cutting means, the thread catching means, and the thread regulating means are arranged adjacent the loop taker 3. A feed dog 6 is arranged rearwardly of the machine needle 1 and is movable up and down and back and forth in a horizontal plane. Further as particularly shown in FIG. 2(*a*), a bobbin carrier 38 is arranged in the loop taker 3. The bobbin carrier 38 is formed to carry therein a bobbin 13 which has the lower thread 29*d* wound therearound. A thread regulating member 7 is arranged as straddling the loop taker 3 forwardly of a machine needle 1. The thread regulating member 7 is extended in the direction along the course where a thread catching member 4 and a movable blade 5 of the thread cutting means are reciprocatingly moved.

The machine body has first and second instruction buttons provided thereon though these are not shown. The first instruction button is operated to give a first instruction signal for cutting both the upper and lower threads. On the other hand, the second instruction button is operated to give a second instruction signal for cutting only the upper thread. The first and second instruction buttons may be replaced by a single button which may be responsive to two different operation modes to give the first and second instruction signals respectively.

With operation of any one of the first and second buttons, the thread catching member 4 is reciprocatingly moved right and left in FIG. 1, thereby to catch both of the upper and lower threads 29*u*, 29*d* or only the upper thread 29*u*, and moves the same to the position where a fixed blade 14 of the thread cutting means is located, the fixed blade 14 being provided to cut the thread in cooperation with the movable blade 5.

Figure 3:
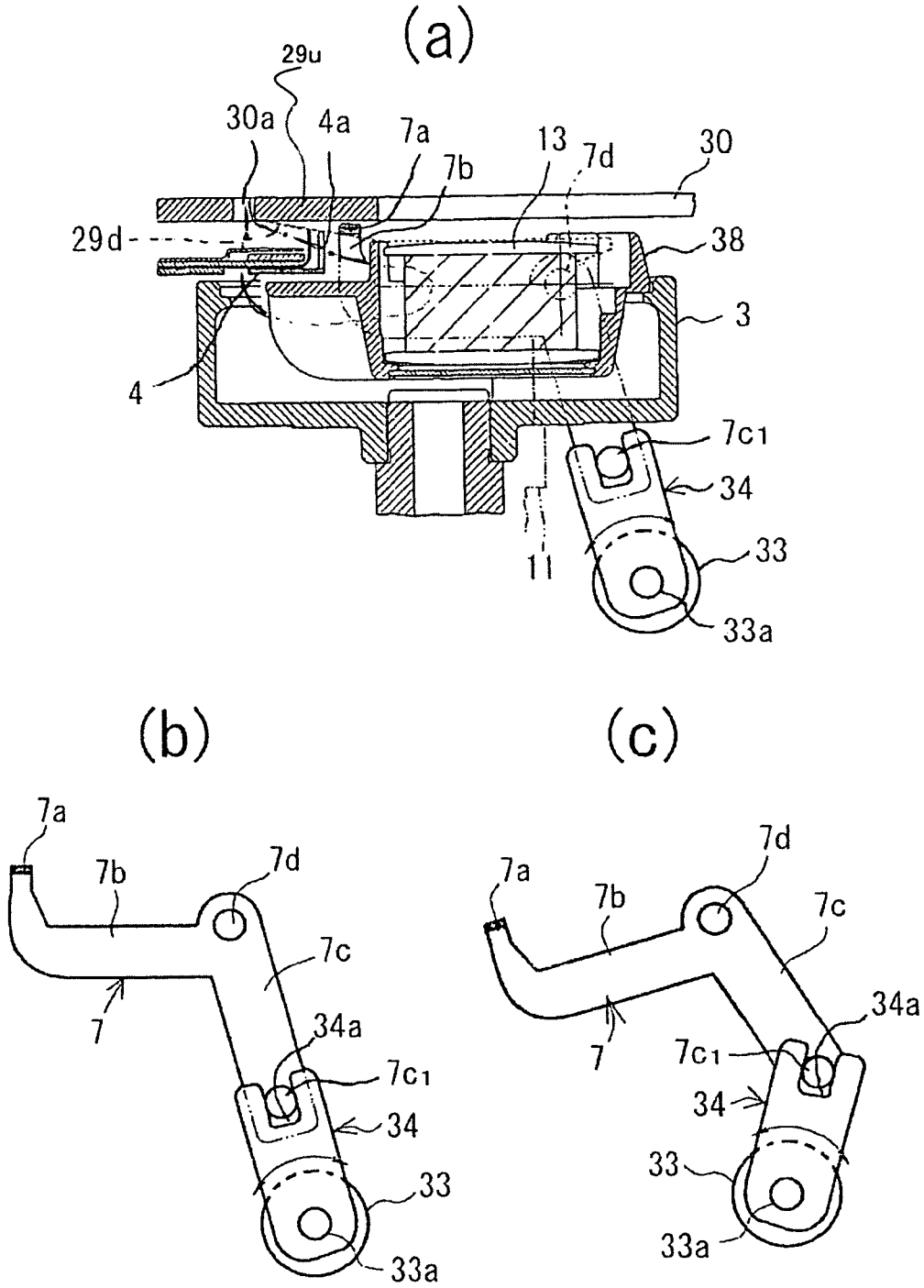
FIG. 3(*a*) is a side elevational view of the invention showing in vertical section a horizontal loop taker, a bobbin carrier placed in the horizontal loop taker, thread cutting means, thread catching means and thread regulating means. (*b*) is a side elevational view of the invention showing in enlarged scale a second drive means for swinging the thread regulating member, the second drive means moved to an inoperative position. (*c*) is a side elevational view of the invention showing in enlarged scale the second drive means for swinging the thread regulating member, the second drive means moved to an operative position.

As shown in FIG. 3, the thread catching member 4 is normally extended below the lower thread 29*d*. In this position, the thread catching member 4 catches the upper thread 29*u* only.

In order to enable the thread catching member 4 to catch the lower thread 29*d*, it is required that the thread regulating member 7 is operated to move the lower thread 29*d* by the thread regulating portion 7*a* down to a position under the thread catching member 4.

With operation of both the first and second buttons, the thread regulating member 7 is operated to move down the upper and lower threads 29*u*, 29*d* to a position where the thread catching member 4 is able to catch both of the upper and lower threads 29*u*, 29*d* and move the same to the position of the fixed blade 14 where the threads are cut.

On the other hand, with operation of the second button only, the thread regulating member 7 is not operated, and the thread catching member 4 is operated to catch the move the upper thread 29*u* only and move the same to the position of the fixed cutter 14 where the thread is cut.

With the structure as mentioned above, the thread cutting mode may be optionally selected for cutting both of the upper and lower threads 29*u*, 29*d* or for cutting the upper thread 29*u* only.

The structure of the invention will be described in detail hereunder.

Figure 5:
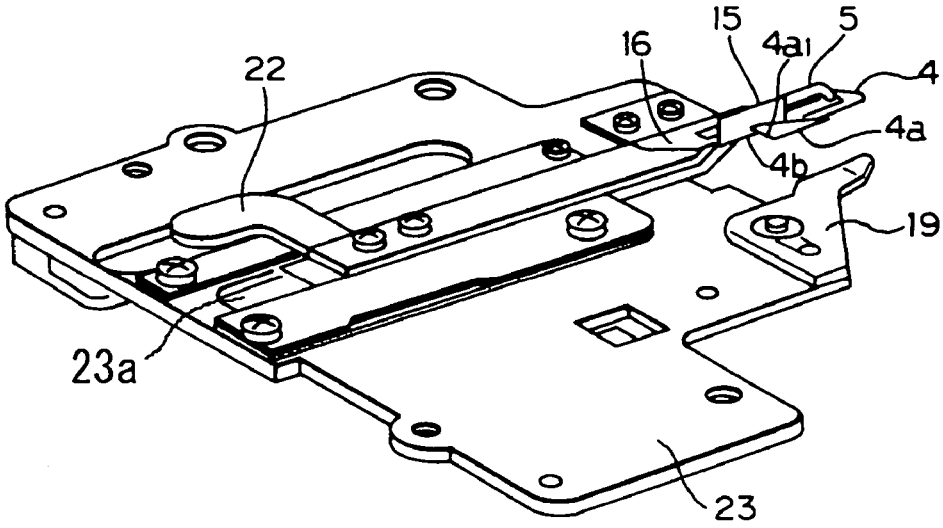
FIG. 5 is a perspective view of the invention showing the thread cutting means and the thread catching means secured to a base plate.
Figure 6:
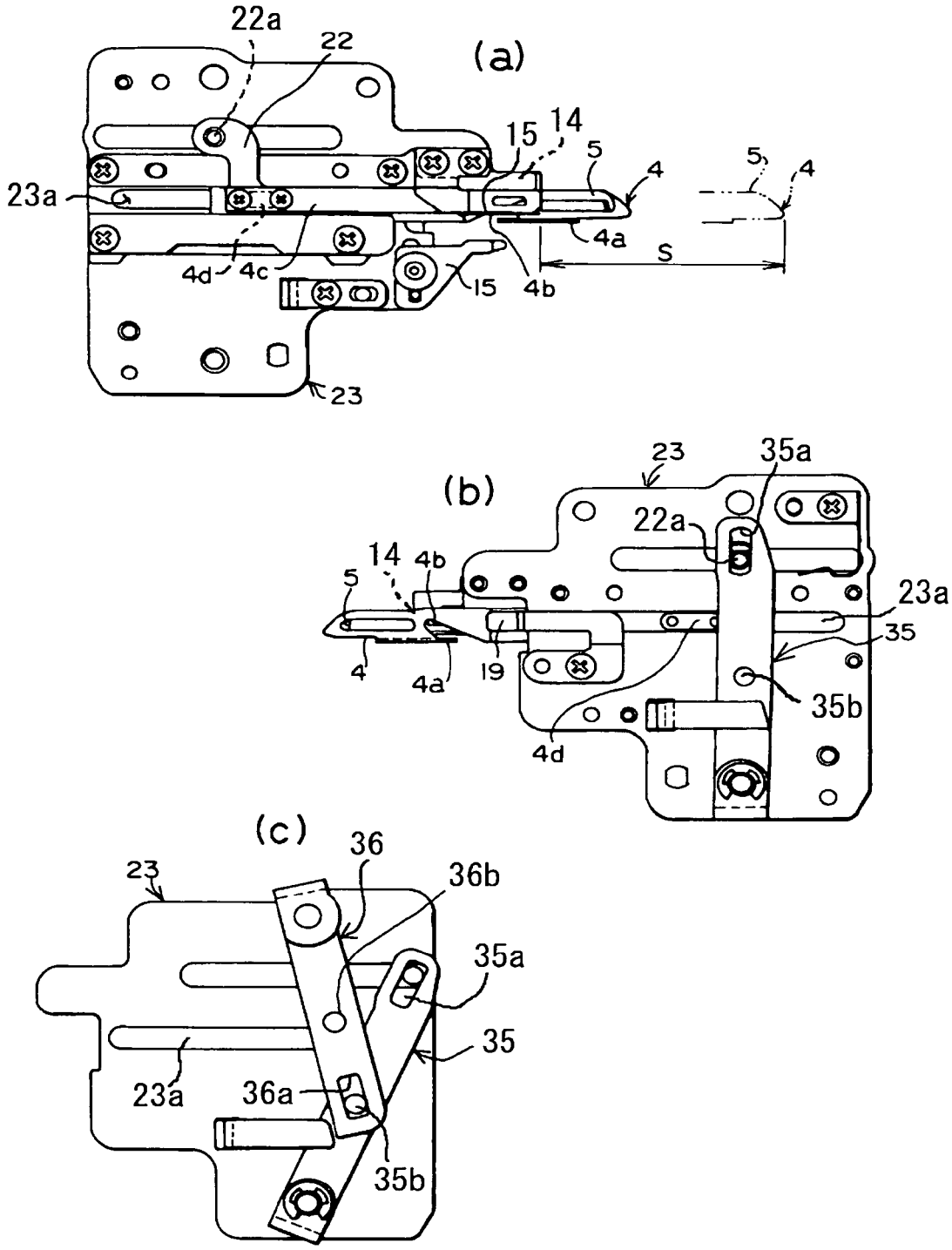
FIG. 6(*a*) is a plan elevational view of the invention showing the thread cutting means and the thread catching means secured to a base plate. (*b*) a rear side plan elevational view of the invention showing the thread cutting means and the thread catching means arranged on the base plate. (*c*) is a rear side plan elevational view of the invention showing transmission links arranged on the base plate.

The thread cutting means includes the movable blade 5 and the fixed blade 14. The thread catching means includes the thread catching member 4. The movable blade 5, the fixed blade 14 and the thread catching member 4 are arranged on a base plate 23 as particularly shown in FIGS. 1, 5 and 6. The thread catching member 4 and the movable blade 5 are formed with elongated thin plates respectively. The thread catching member 4 is slidingly moved in the longitudinal direction and is formed with a hook 4*a* at one end portion for catching the upper and lower threads 29*u*, 29*d* as shown in FIGS. 5 and 6(*a*), (*b*). The hook 4*a* is formed with a part of the elongated plate 4 which is generally of acute triangle and is vertically bent down on one side of the elongated plate 4. The elongated plate is further formed with a U-shaped cutout 4*b* which is opened adjacent the hook 4*a* and is extended toward the end portion of the plate 4 as shown in FIGS. 1 and 6(*b*).

The thread catching member 4 is designed to catch the thread by the hook 4*a* and guides the thread into the cutout 4*b* and to the underside of the fixed cutter 14. The hook 4*a* is, as mentioned above, generally of triangle with acute angle θ provided by the hook edge 4*a*1 and the plate 4 as particularly shown in FIG. 9(*a*) so as to catch the upper and lower threads 29*u*, 29*d*. Further, as shown in FIG. 1, the cutout 4*a* is extended toward the end portion of the plate 4 to prevent the upper and lower threads 29*u*, 29*d* caught by the hook 4*a* from slipping out of the cutout 4*b*. The movable blade 5, that is, the elongated thin plate, has a blade edge formed at one end thereof. The blade edge is bent substantially at right angle in the horizontal plane.

Figure 2:
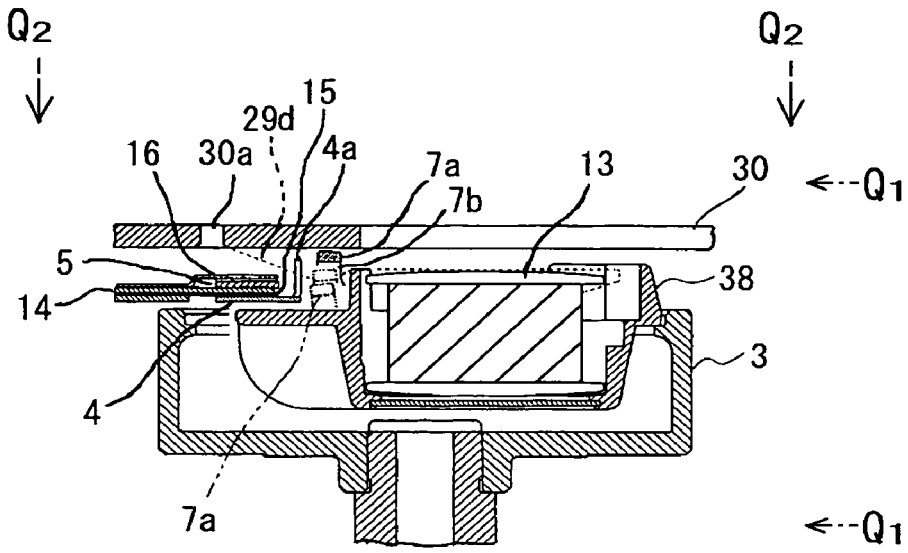
FIG. 2(*a*) is a side elevational view of the invention showing in enlarged vertical section a horizontal loop taker, a bobbin carrier placed in the horizontal loop taker, thread cutting means, thread catching means and thread regulating means. (*b*) is a side elevational view of the invention showing in enlarged scale a first drive means for swinging a thread regulating member.
Figure 2:
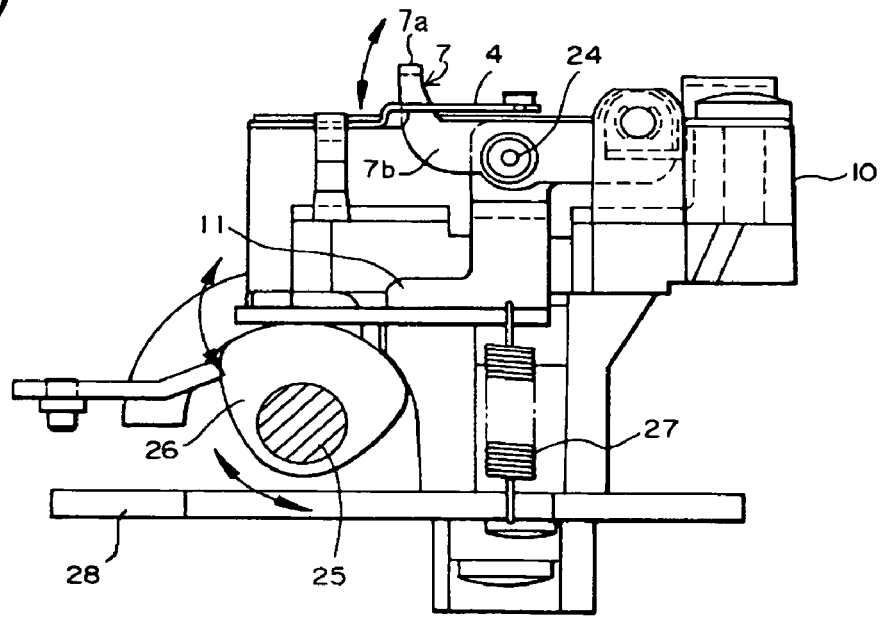

As particularly shown in FIGS. 2(*a*) and 3(*a*)and 5, the movable blade 5 is superimposed on the thread catching member 4 and fixed together in one body. The movable blade 5 is movable together with the thread catching member 4 in the longitudinal direction on the base plate 23. Further as shown in FIGS. 5 and 6, the base plate 23 has an elongated guide groove 23*a* formed thereon for guiding the movable cutter 5 when the same is moved in the longitudinal direction.

A rectangular slide member 4*d* is placed in engagement with the guide groove 23*a* so as to be slidingly moved along the guide groove 23*a*. As particularly shown in FIG. 6(*b*), the thread catching member 4 and the movable blade 5 are fixed to the slide member 4*d* as superimposed by means of screws or the like, so that the thread catching member 4 and the movable blade 5 may be moved together along the guide groove 23*a*. The moving range is as shown by the arrow mark S in FIG. 6(*a*).

The fixed blade 4 and a thread guide 15 are arranged between the movable blade 5 and a thread guide 15, that is, below the movable blade 5. A member 16 is provided above the movable blade 5 to regulate the movement of the movable blade 5. These members 14, 15, 16 are secured to the base plate 23 by means of screws or the like as shown in FIGS. 5 and 6.

The thread catching member 4 and the movable blade 5 are connected to a transmission member 22 as shown in FIGS. 5 and 6(*a*). The transmission member 22 is pivotally connected to a transmission link 35 which is arranged on the rear side of the base plate 23 as shown in FIG. 6(*b*), (*c*). The transmission link 35 has one end pivotally connected to the base plate 23 and has the opposite end connected to the transmission member 22 by means of a pin 22*a* which is secured to the transmission member 22 and is inserted into an oblong slot 35*a* formed at the transmission link 35.

Incidentally, the pin 22*a* may be secured to the transmission link 35 while the oblong slot 35*a* is formed at the drive member 22. The transmission link 35 is connected to another transmission link 36 which has one end pivotally connected to the base plate 23 and has the opposite end formed with an oblong slot 36*a*. The transmission link 35 is connected to the drive link 36 by means of a pin 35*b* which is secured to the transmission link 35 and is inserted into the oblong slot 36*a* formed at the transmission link 36 as shown in FIG. 6(*c*).

Figure 7:
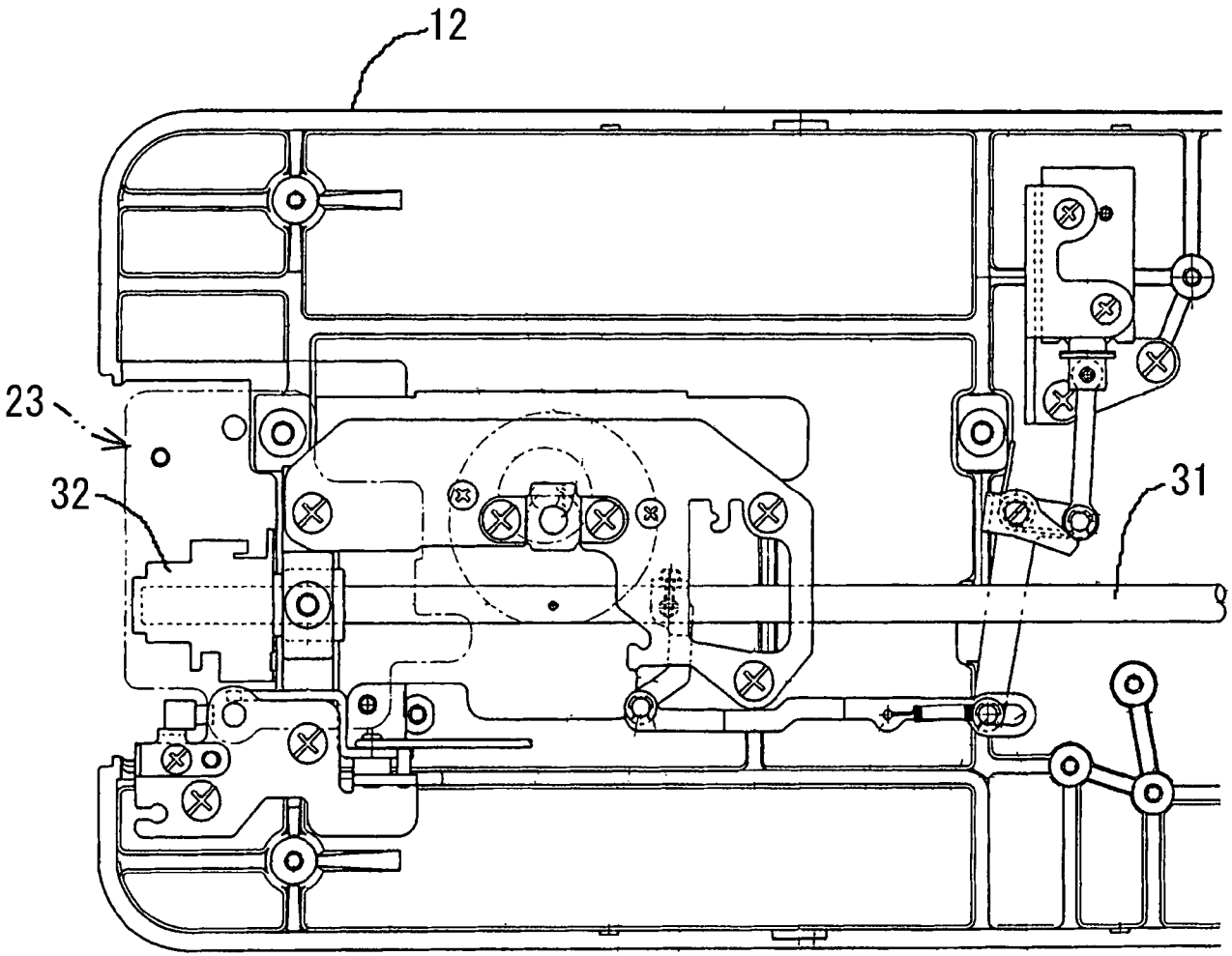
FIG. 7 is a bottom side view of a machine bed showing the essential parts of the invention.

The transmission link 36 is provided so as to be driven under control of a control cam 32 which is secured to a lower drive shaft 31 arranged in the machine bed 12 so as to be rotated thereby as shown in FIG. 7. The controlled motion of the transmission link 36 is transmitted to the thread catching member 4 and the movable blade 5 through the transmission link 35, the pin 22*a* and the drive member 22. Thus the thread catching member 4 and the movable blade 5 may be reciprocatingly moved as guided by the guide groove 23*a* to perform a thread cutting operation. The motion of the control cam 32 is transmitted to the thread catching member 4 and the movable blade 5 only when the aforementioned first or second instruction button (not shown). The thread catching member 4 and the movable blade 5 are normally located at the most leftward position in FIG. 1.

The reference numeral 17 is a detent lever for preventing the bobbin 13 from making empty rotation immediately after the thread is cut. The detent lever 17 is normally under the action of a detent member 18. The reference numeral 19 is a detent arm for normally preventing the bobbin carrier 38 from making rotation while the loop taker 3 is rotated. The loop taker 3 is peripherally surrounded by a cover 10 which has a stop member 20 for regulating the rotation of the bobbin carrier 38. With the structure as such, the upper thread 29*u* is caught by the hook (not shown) of the loop taker 3 as the latter is rotated and is moved around the bobbin carrier 38 passing through the stop member 20. As the upper thread 29*u* passes through the stop member 20, the upper thread 29*u* is caught by the hook 4*a* of the thread catching member 4 which is located at the most leftward position in FIG. 1.

Figure 8:
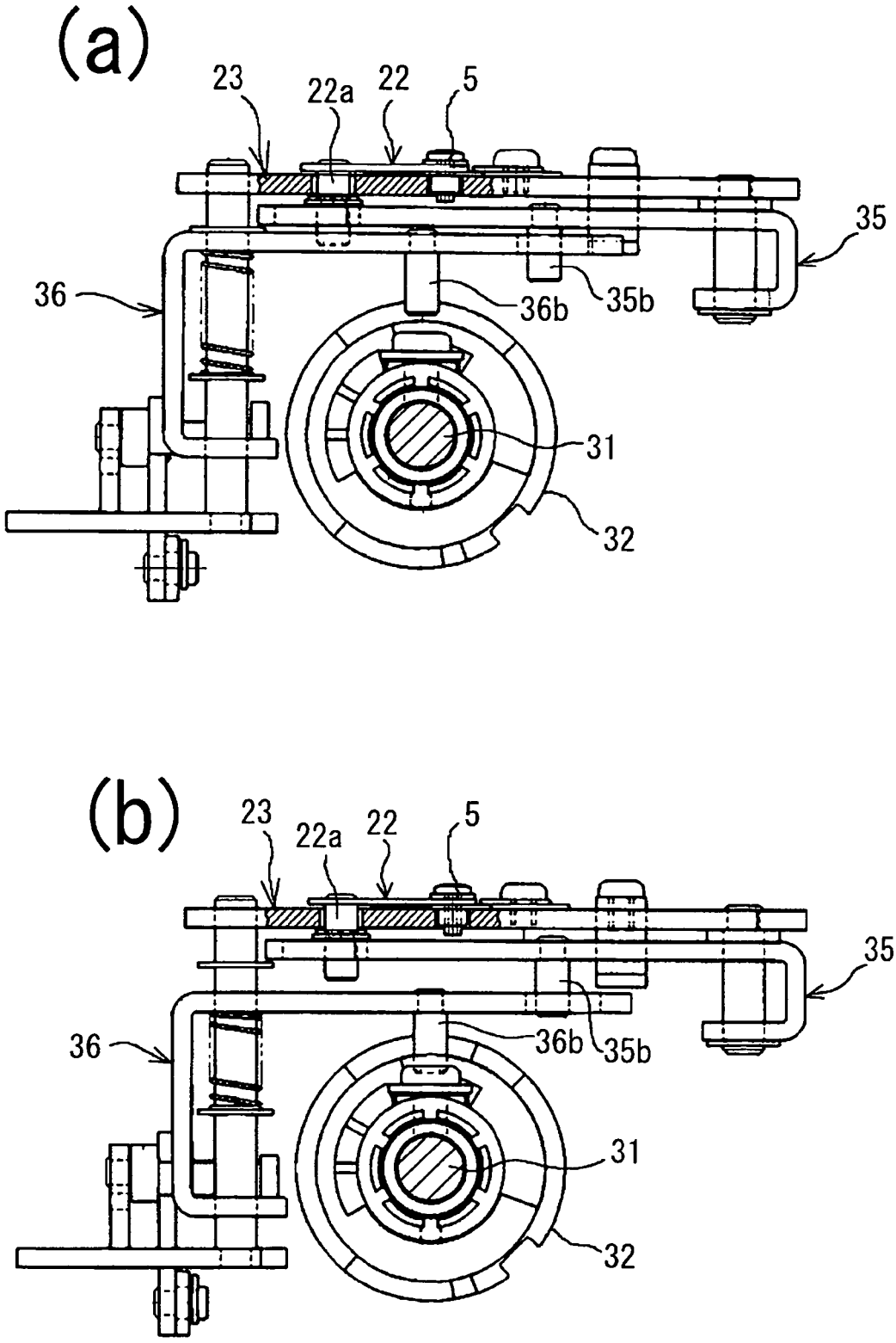
FIG. 8(*a*) is a front elevational view of the invention showing partly in section a control cam and transmission links disconnected. (*b*) is a front elevational view of the invention showing partly in section a control cam and transmission links connected.

Then with a thread cutting signal produced from the first or second operating buttons operated by the machine operator , a drive force is transmitted to the drive member 22 from the control cam 32 for operating the thread catching member 4 to move the upper thread 29*u* along the thread guide 15 to a thread cutting position. More precisely, with the signal produced from the first or second operating buttons, the transmission link 36 is moved toward the control cam 32 as shown in FIG. 8(*a*),(*b*), and the pin 36*b* comes to engage the groove of the control cam 32 which will make an action for reciprocatingly move the thread catching member 4 and the movable blade 5 through the transmission link 36, the transmission link 35 and the drive member 22. Normally the thread catching member 4 and the movable blade 5 are located at the most leftward position in FIG. 1 where the transmission link 36 is not connected to the control cam 32.

Further, there is provided a thread regulating means including a thread regulating member 7. As shown in FIG. 1, the thread regulating member 7 is swingably supported on the cover 10 by means of a pair of pins 8,9. Precisely, the thread regulating member 7 is composed of an elongated thread regulating bar 7*a* for regulating the lower thread 29*d*, and extending substantially in parallel with the thread catching member 4 and the movable blade 5, and a pair of swingable arms 7*b*, 7*b*.

Figure 4:
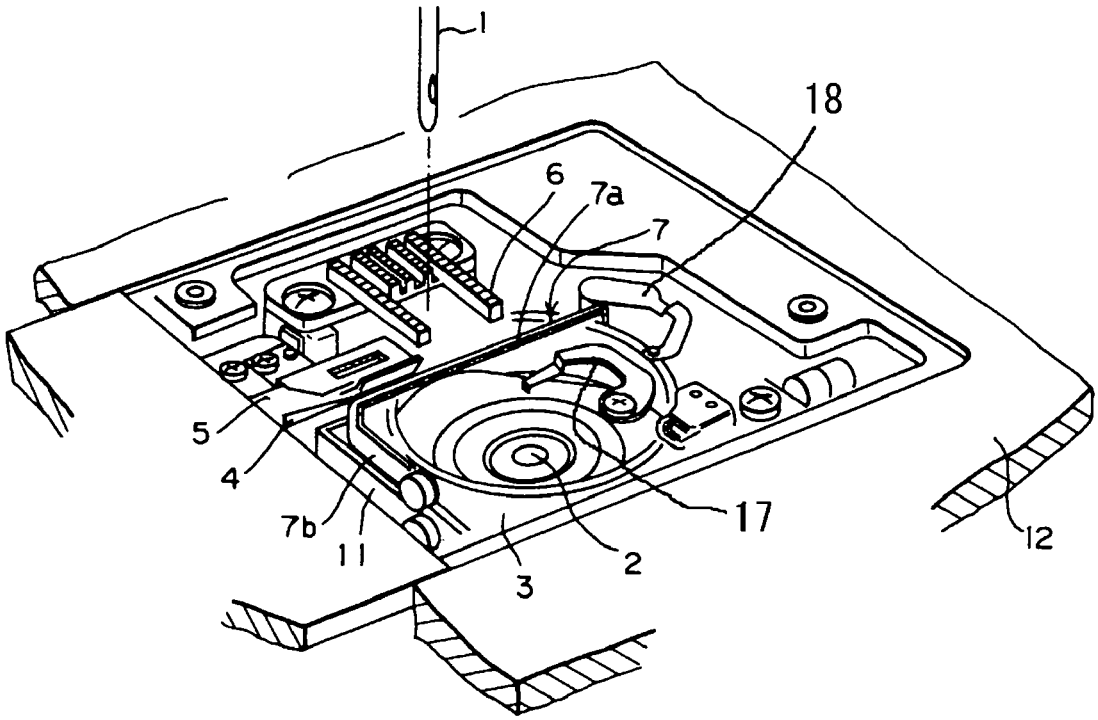
FIG. 4 is a perspective view of the essential parts of the invention shown as exposed when a needle plate is removed.

As shown in FIG. 2(*b*), the swingable arms 7*b*, 7*b* have one end connected to the opposite ends of the thread regulating bar 7*a* and the other end pivotally connected to the thread regulating stand 11 and have the intermediate portions pivotally connected to a thread regulating stand 11 by means of screws 24 or the like as shown in FIG. 4 and FIG. 2(*b*).

The thread regulating stand 11 is normally urged to a lower direction under the action of a compression spring 27 having one end anchored to the eccentric cam 26 is and the opposite end anchored to a plate 28. An eccentric cam 26 is secured to a lower rotary shaft 25 which is different from the aforementioned lower drive shaft 31. The lower rotary shaft 25 is designed to rotate in response to the instruction signal from the first instruction button (not shown) which is operated to cut both of the upper and lower threads 29*u*, 29*d*. The eccentric cam 26 is rotated to move up and down the thread regulating stand 11 against and under the action of the compression spring 27 and to move eccentric cam 26, and accordingly the thread regulating bar 7*a* is moved up and down. The thread regulating stand 11, the eccentric cam 26 and the compression spring 27 may be comprehensively called a first actuating means.

Further, the thread regulating member 7 is moved under the control of a second actuating means as shown in FIG. 3. As aforementioned, the swingable arms 7*b*, 7*b* are pivotally connected to the thread regulating stand 11 in the machine bed 12 at the pivot points 7*d* respectively as shown in FIG. 3(*a*). As shown in FIG. 3(*b*)and (*c*), the swingable arms 7*b*, 7*b* are further extended downwardly from the pivot points 7*d* into transmission arms 7*c* respectively. The transmission arms 7*c* have transmission pins 7*c*1 provided at the lower end thereof, the transmission pins 7*c*1 engaging the forked portions 34*a* of the drive arms 34 secured to a drive shaft 33*a* of a stepping motor 33. Thus the thread regulating bar 7*a* of the thread regulating member 7 may be swingingly moved around the pivot points 7*d* as the stepping motor 33 is driven.

When there is no thread cutting instruction signal and the stepping motor 33 is not driven, the thread regulating bar 7*a* of the thread regulating member 7 is maintained at an upper position. In this condition, the lower thread 29*d* is not pressed down by the thread regulating member 4, wherein the lower thread 29*d* is not caught by the hook 4A of the thread catching member 4. On the other hand, the upper thread 29*u* is caught by the hook 4*a* of the thread catching member 4 so as to be cut by the movable blade 5 irrespectively of the up and down movement of the thread regulating member 7. Therefore, the upper thread 29*u* may be cut by the thread catching member 4 and the movable blade 5 which are operated in response to the instruction signal for cutting the upper thread 29*u* only.

In case the instruction signal is produced for cutting both of the upper and lower threads 29*u*, 29*d*, the stepping motor 33 is driven to move down the lower thread 29*d* by the thread regulating member 7, so that the lower thread 29*d* may be caught by the thread catching member 4 together with the upper thread 29*u*. As the result, both of the upper and lower threads 29*u*, 29*d* are cut by the movable blade 5 which is effective in cooperation with the fixed blade 14.

Thus the stepping motor 33 is selectively driven to cut the lower thread 29*d* together with the upper thread 29*u*. Namely the thread cutting operation for cutting the upper thread only or both of the upper and lower threads may be performed selectively and assuredly.

Figure 9:
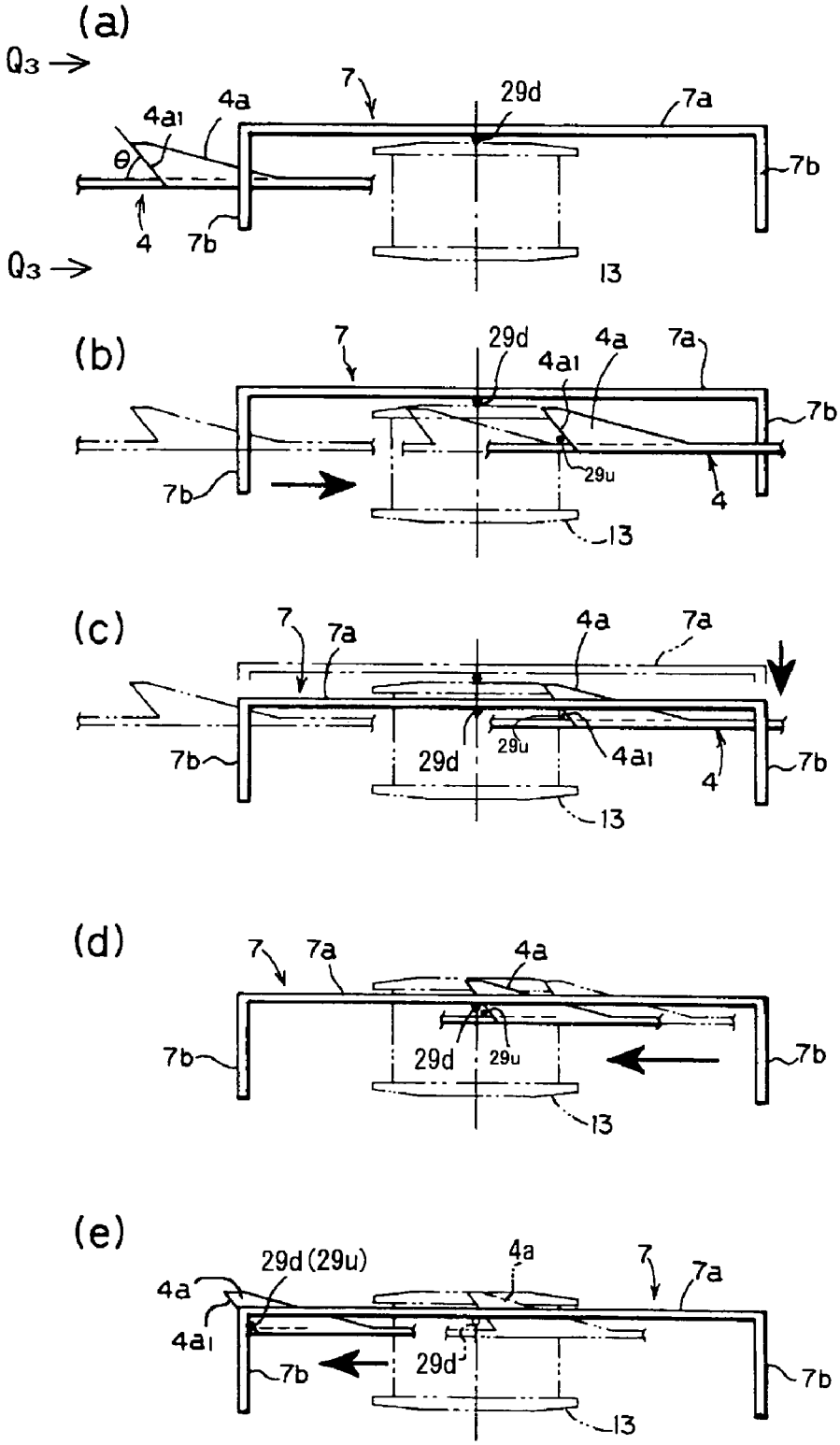
FIG. 9(*a*)~(*e*) are explanatory views of the invention taken from the arrow marks Q1~Q1 in FIG. 2 and showing the processes for cutting the lower thread.

Subsequently, the process will be described for cutting both of the upper and lower threads 29*u*, 29*d* by means of the thread regulating means, the thread catching means and the thread cutting means. FIG. 9(*a*)~(*e*) show a series of thread cutting processes by means of the essential parts of the invention taken from the arrow marks Q1-Q1 in FIG. 2(*a*). The figures (*a*) in FIGS. 10~17 show a series of thread cutting processes by means of the essential parts of the invention taken from the arrow marks Q2-Q2 in FIG. 2 (*a*). The figures (bare side elevational views of the thread regulating member 7 of the invention taken from the arrow marks Q3-Q3 in FIG. 9(*a*).

These figures show a series of processes for cutting both of the upper and lower threads 29*u*, 29*d*, wherein the thread regulating bar 7(*a*) of the thread regulating member 7 is located between the thread catching member 4 and the bobbin carrier 38 and is extended above the path of the lower thread 29*d* which is extended from the bobbin 13 to the needle dropping hole 30*a* of the needle plate 30, as aforementioned. Further the thread regulating bar 7(*a*)is extended substantially in parallel with the moving path of the thread catching member 4 and the movable blade 5.

In the first process in FIGS. 9(*a*) and 10(*a*),the forward end portions of thread catching member 4 and movable blade 5 are located as inoperative at the left end side of the moving path and are located within the base plate 23. In this situation, the thread regulating bar 7(*a*) of the thread regulating member 7 is located at a level higher than the hook 4*a* of the thread catching member 4 while the lower thread 29*d* is located at a level higher than the hook 4*a* of the thread catching member 4 as shown in FIGS. 9(*a*) and 10(*b*).

Figure 10:
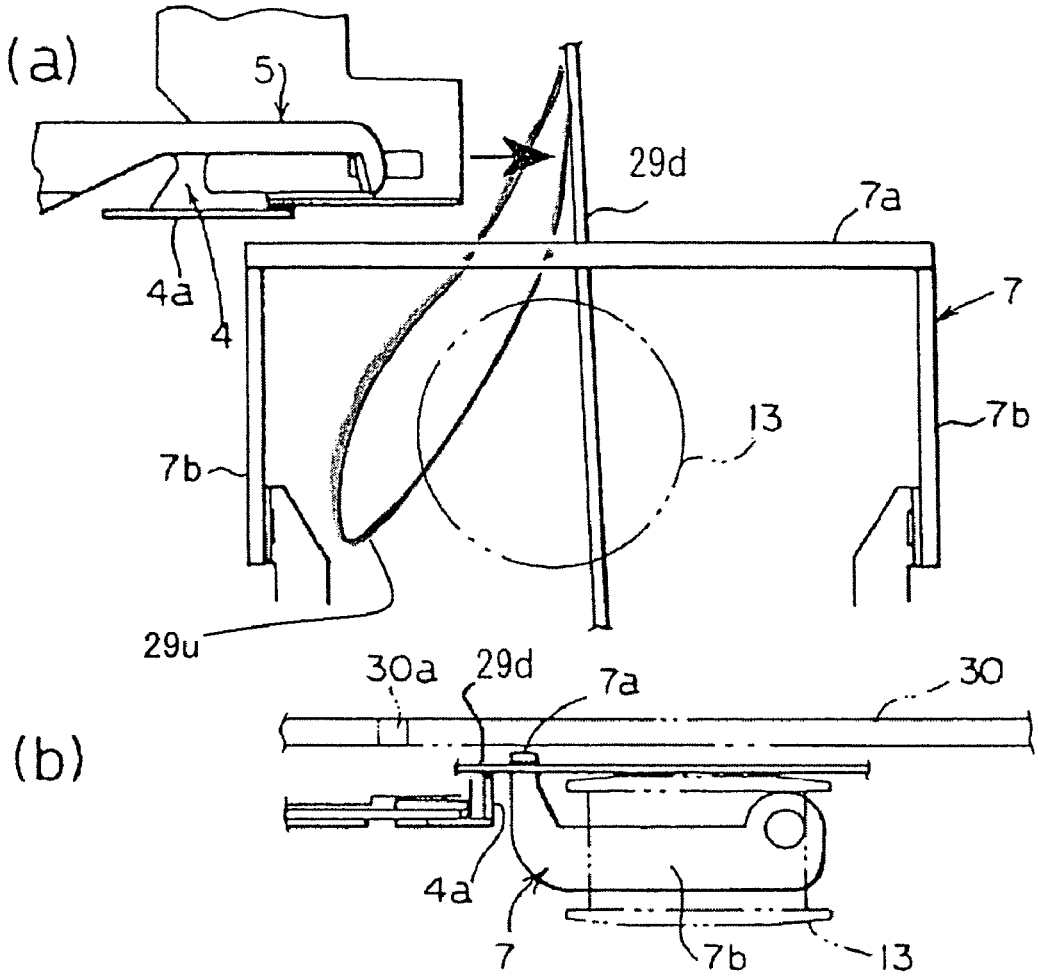
FIG. 10(*a*) is a plan elevational view of the invention showing an initial process for cutting the lower thread. (*b*) is a side elevational view of (*a*).
Figure 11:
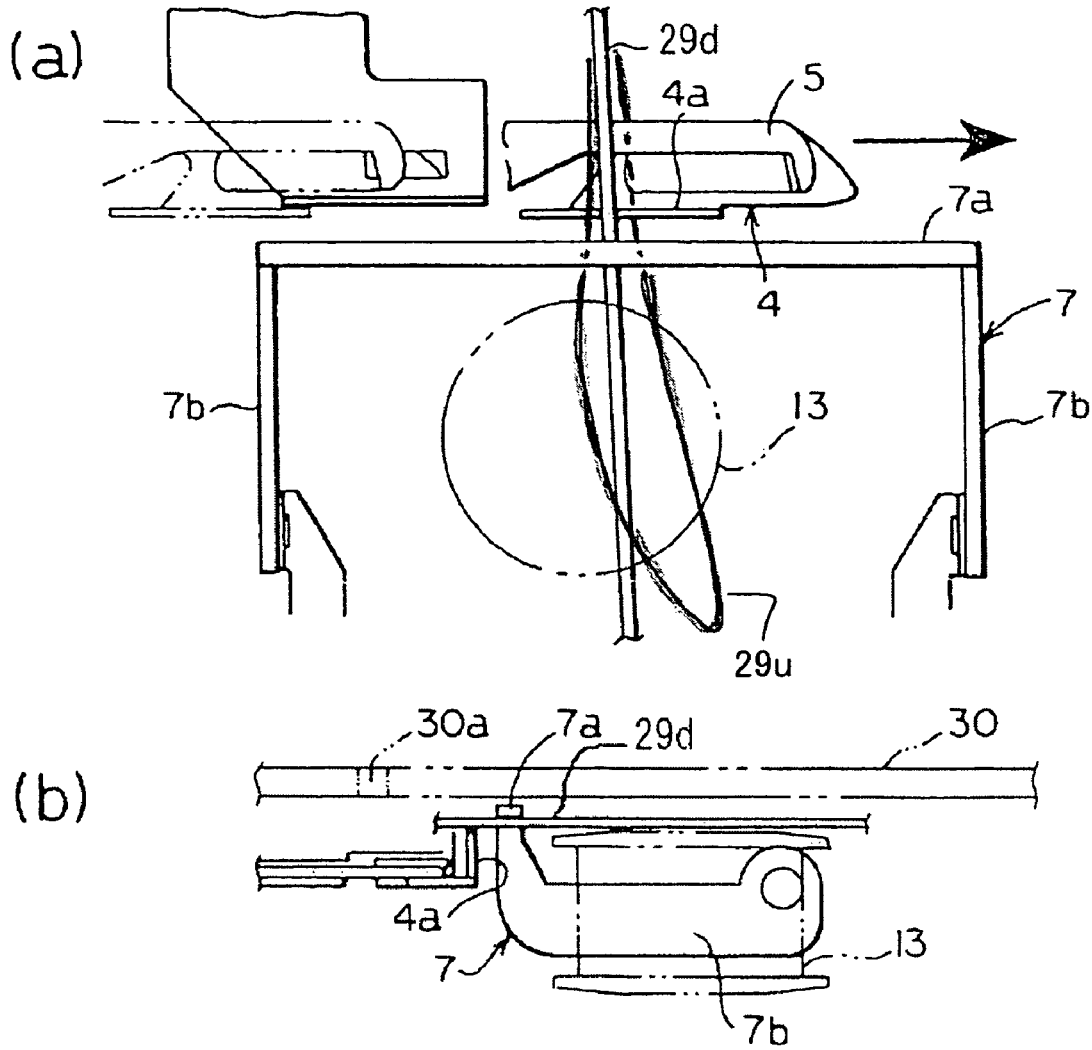
FIG. 11(*a*) is a plan elevational view of the invention showing a thread catching member and a movable blade moving in one-way of reciprocation. (*b*) is a side elevational view of (*a*).
Figure 12:
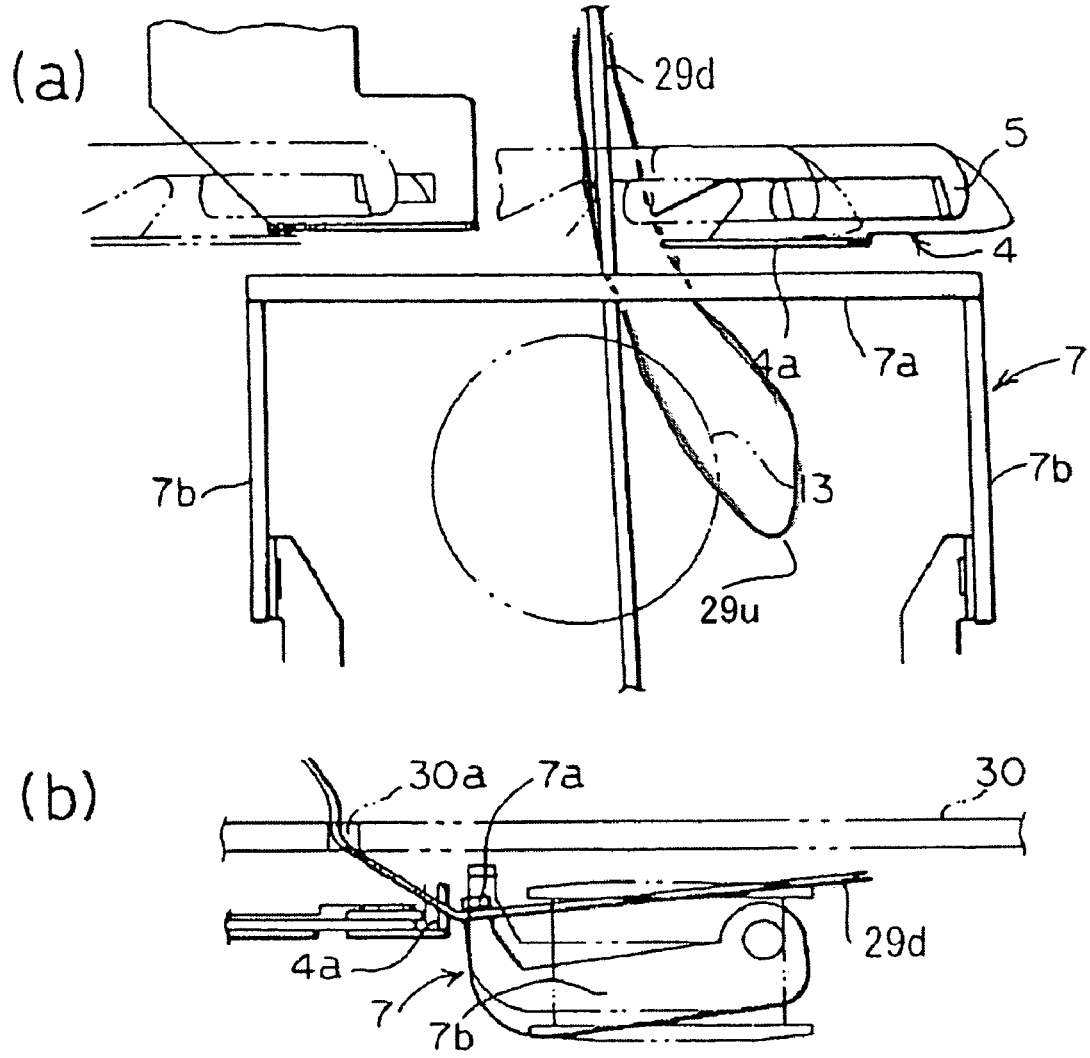
FIG. 12(*a*) is a plan elevational view of the invention showing the thread catching member and the movable blade coming to the end of one-way of reciprocation. (*b*) is a side elevational view of (*a*).
Figure 13:
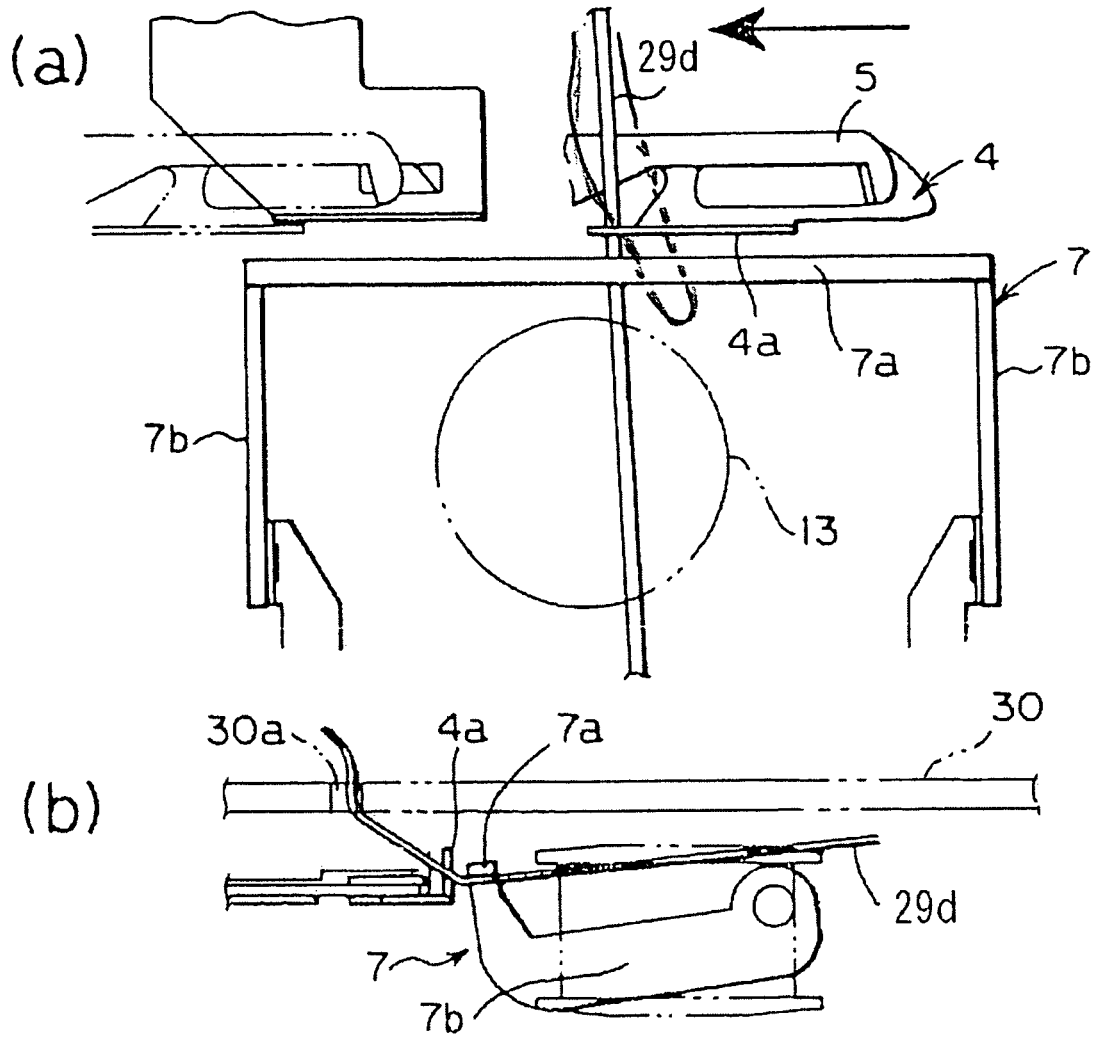
FIG. 13(*a*) is a plan elevational view of the invention showing the thread catching member catching the lower thread in the return-way of reciprocation. (*b*) is a side elevational view of (*a*).

In the second process, as shown in FIGS. 9(*b*) and 11(*a*) wherein the instruction signal is produced for cutting both of the upper and lower threads 29*u*, 29*d*, the thread catching member 4 and the movable blade 5 are moved in one-way of reciprocation in the direction as shown by the arrow mark while the thread regulating bar 7(*a*) of the thread regulating member 7 is located at a level higher than the hook 4*a* of the thread catching member 4. In the meantime, the upper thread 29*u* forms a loop, as shown in FIG. 10,as the lop taker 3 is rotated, and the thread catching member 4 and the movable blade 5 are going to pass through the loop.

In the third process, the thread catching member 4 and the movable blade 5 are stropped at the end of the one-way as shown in FIGS. 9(*c*) and 12(*a*) while the thread regulating bar 7(*a*) of the thread regulating member 7 is located at a level lower than the top of the hook 4*a* of the thread catching member 4 and presses down the lower thread 29*d* as shown in FIGS. 9(*c*) and 12(*b*).

Figure 14:
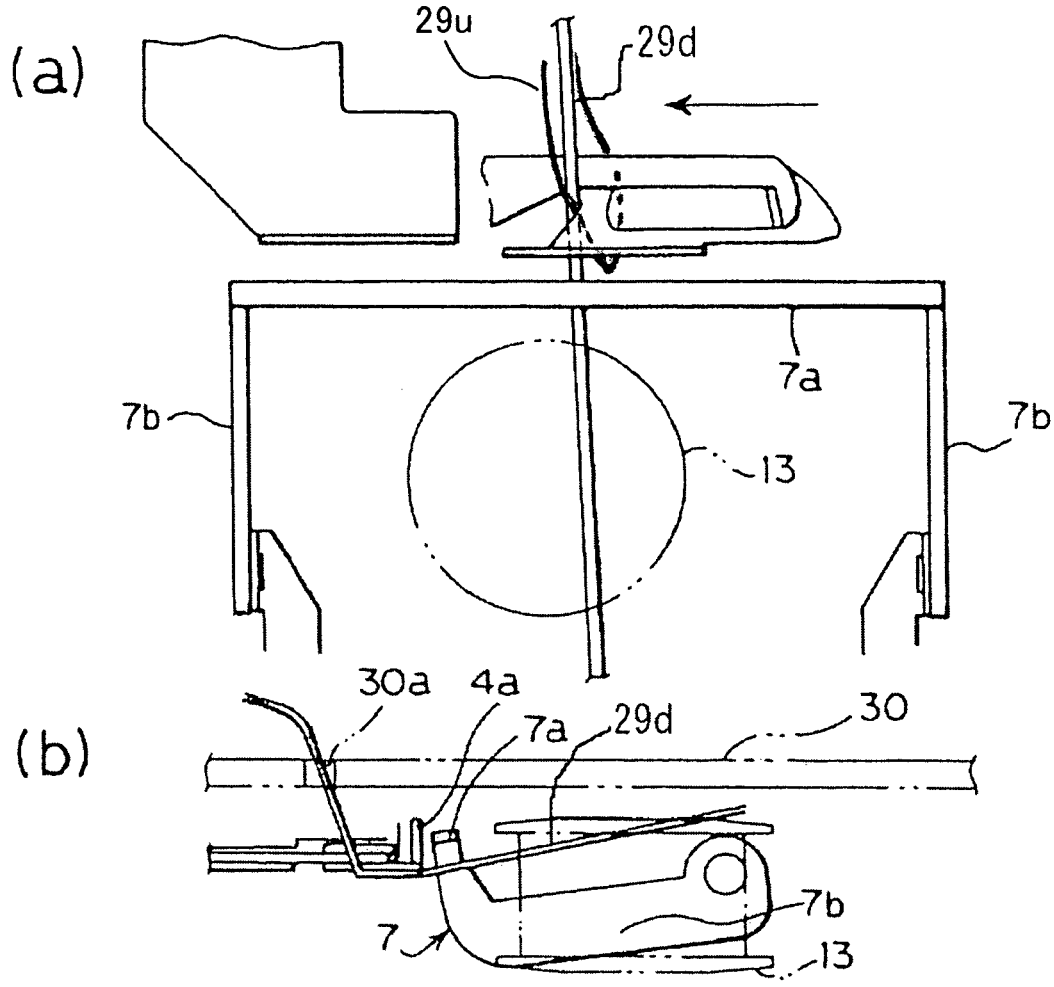
FIG. 14(*a*) is a plan elevational view of the invention showing the thread catching member catching the lower thread in the return-way of reciprocation and further guiding the lower thread into a cutout of the thread catching member. (*b*) is a side elevational view of (*a*).
Figure 15:
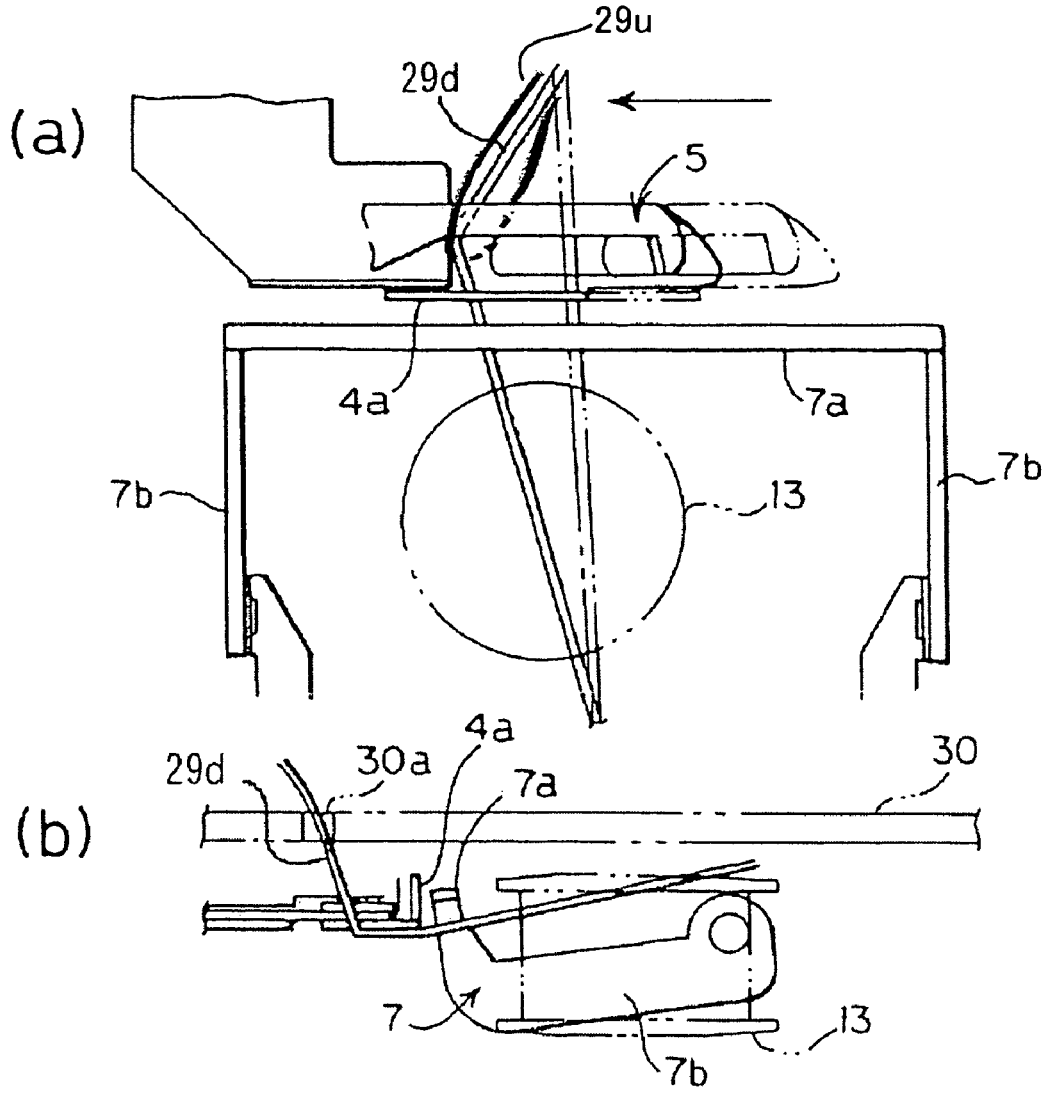
FIG. 15(*a*) is a plan elevational view of the invention showing the thread catching member taking the lower thread to a fixed blade in the return-way of reciprocation. (*b*) is a side elevational view of (*a*).

In the fourth process wherein the thread catching member 4 and the movable blade 5 are going to move in the return-way of reciprocation in the direction as shown by the arrow mark in FIGS. 9(*d*) and 13(*a*). On the way, the hook 4*a* of the thread catching member 4 catches the upper and lower threads 29*u*, 29*d* as shown in FIGS. 9(*d*) and 13(*a*), (*b*). The upper and lower threads 29*u*, 29*d* as caught are guided into the cutout 4*b* of the thread catching member 4 and thus prevented from slipping out of the thread catching member 4 as shown in FIG. 14(*a*), (*b*).

Figure 16:
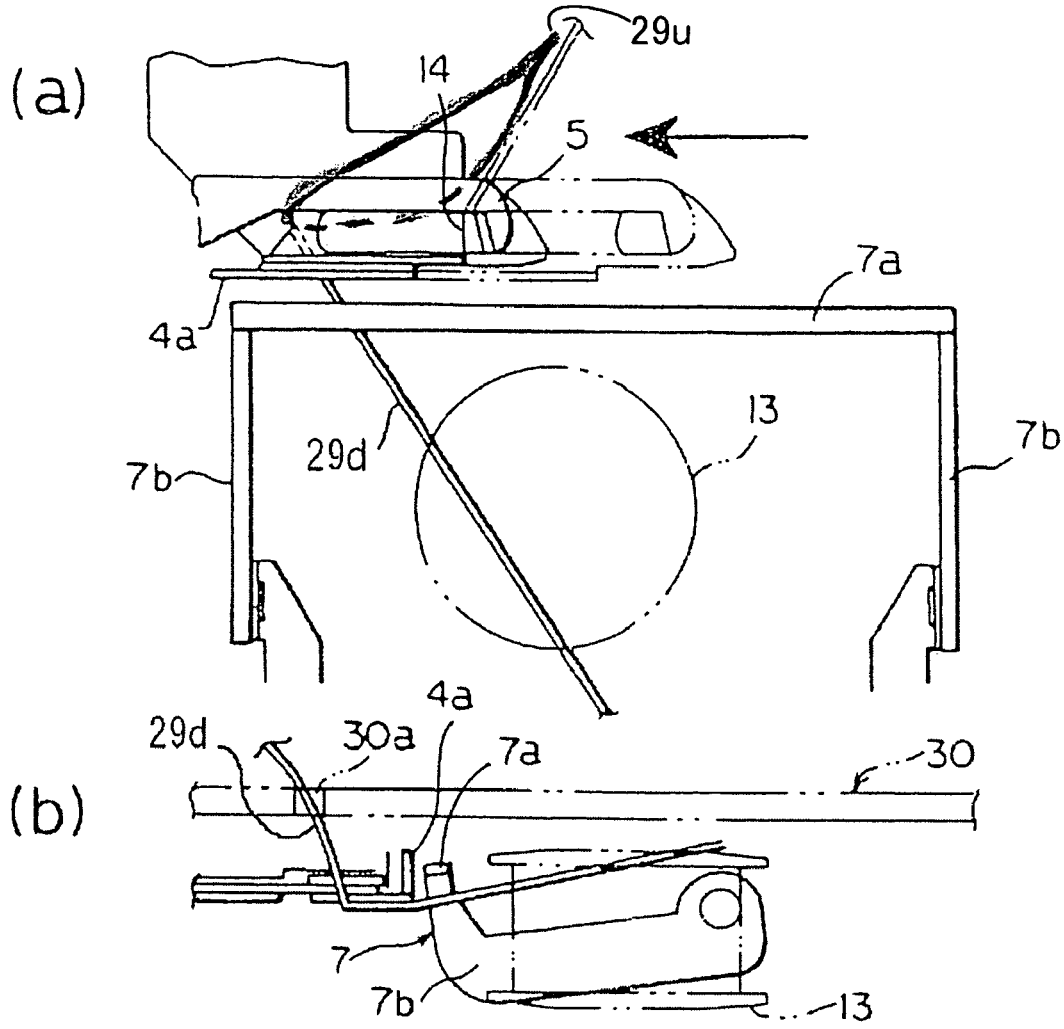
FIG. 16(*a*) is a plan elevational view of the invention showing the process that the movable blade and the fixed blade are in cooperation with each other to cut the lower thread. (*b*) is a side elevational view of (*a*).
Figure 17:
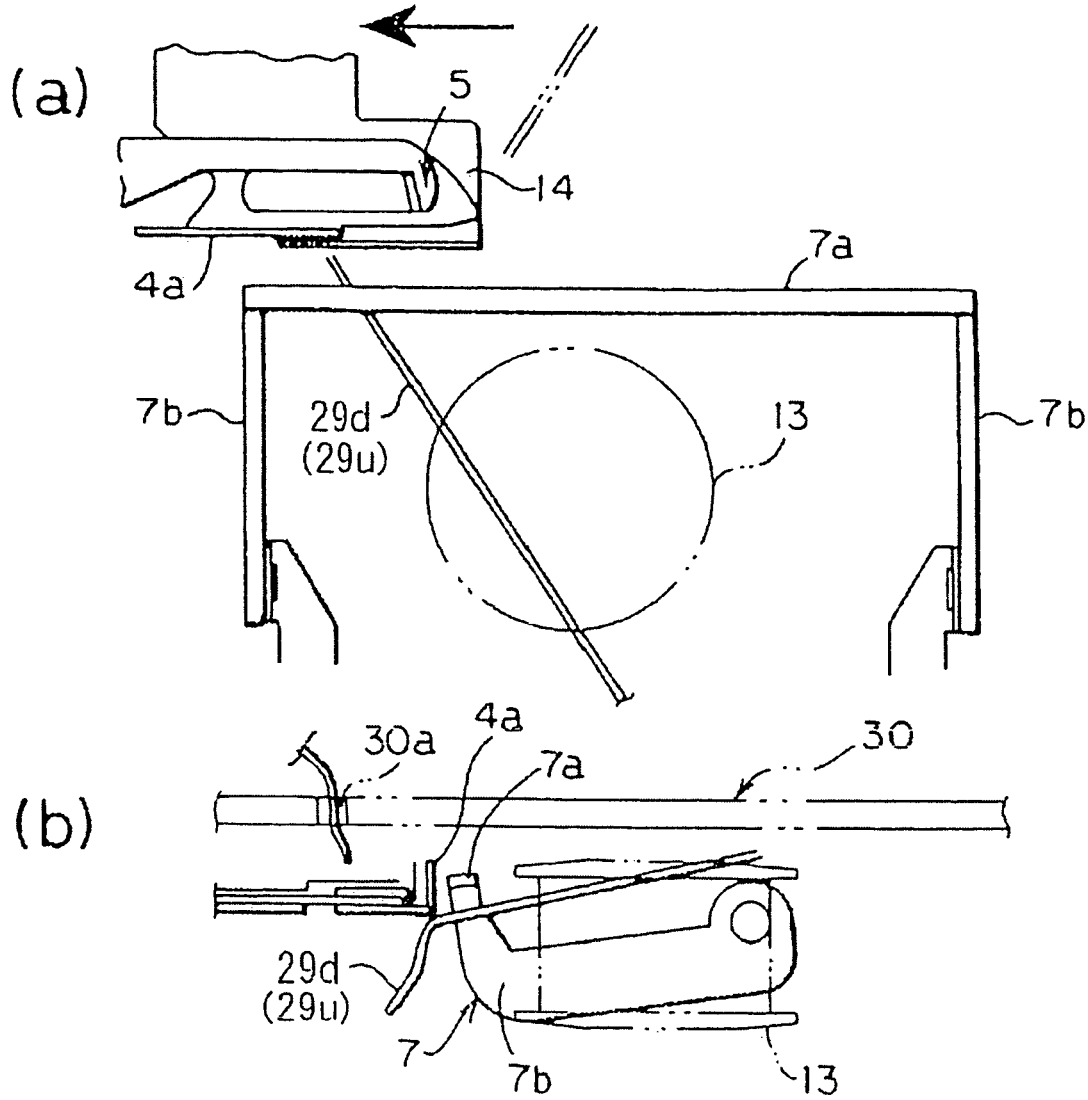
FIG. 17(*a*) is a plan elevational view of the invention showing the process that the movable blade and the fixed blade are in cooperation with each other to have cut the lower thread. (*b*) is a side elevational view of (*a*).

In the fifth process, the upper and lower threads 29*u*, 29*d* as caught by the thread catching member 4 are moved in the return-way to the position of the fixed blade 14 as shown in FIGS. 9(*e*), 15(*a*), (*b*). Then the upper and lower threads 29*u*, 29*d* are cut by the movable blade and the fixed blade 14 operated in cooperation as shown in FIGS. 16 and 17. When the thread cutting instruction is cleared out, the thread regulating bar 7*a* of the thread regulating member 7 is returned to the inoperative high position where the thread regulating bar 7*a* gives no influence to the lower thread 29*d* which may otherwise be caught by the thread catching member 4 in the thread cutting operation.

Incidentally, in case only the upper thread is cut, the thread regulating bar 7*a* is not moved down in the third process. The lower thread 29*d* is, therefore, not pressed down by the thread regulating bar 7*a*. In this case, the thread catching member 4 is moved simply below the lower thread 29*d* and catches the upper thread 29*u* only.

What is claimed is:

1. An automatic thread cutting device for a sewing machine which is provided with a horizontal loop taker, the automatic thread cutting device comprising: a thread catching means operated in response to a first instruction signal for cutting both of the upper and lower threads of the sewing machine to reciprocatingly move in one direction and in a return direction along a predetermined course to catch the upper and lower threads, the thread catching means operated in response to a second instruction signal for cutting the upper thread only of the sewing machine to reciprocatingly move along a predetermined course to catch the upper thread while moving below the lower thread, a thread cutting means for cutting the upper and lower threads which may be caught by the thread catching means, a thread regulating means operated in response to the first instruction signal to move down the lower thread to a position where the lower thread is caught by the thread catching means as the latter is reciprocatingly moved, wherein said thread regulating means includes an elongated bar for pressing down the lower thread, the elongated bar extending along the reciprocating path of a thread catching member of the thread catching means and simultaneously extending across and above the lower thread which extends from a bobbin carried in the horizontal loop taker to a needle dropping hole of a needle plate, said thread regulating means further including swingable arms connected to the opposite ends of the elongated bar respectively and operated to move down the elongated bar only when the thread catching member is moved in said return direction of reciprocating movement.

2. The automatic thread cutting device as defined in claim 1 wherein: the thread cutting means includes a movable blade which is reciprocatingly moved with the thread catching means and a fixed blade for cutting the threads in cooperation with the movable blade, the threads being guided to the fixed blade by the thread catching means, and wherein: the thread catching means is normally reciprocatingly moved with the movable blade below the lower thread as the latter is extended and catches the upper thread only in the one-way of reciprocation and takes the upper thread to the fixed blade.

3. The automatic thread cutting device as defined in claim 2 wherein: the thread regulating means is operated by a stepping motor which is driven.

4. The automatic thread cutting device as defined in claim 2 wherein: the thread regulating means is operated by a cam.

5. The automatic thread cutting device as defined in claim 1 wherein: the thread regulating means is operated by a stepping motor which is driven.

6. The automatic thread cutting device as defined in claim 1 wherein: the thread regulating means is operated by a cam.

* * * * *